US011568699B2

(12) United States Patent
Haishima

(10) Patent No.: US 11,568,699 B2
(45) Date of Patent: Jan. 31, 2023

(54) BANKNOTE PROCESSING SYSTEM

(71) Applicant: Universal Entertainment Corporation, Tokyo (JP)

(72) Inventor: Jun Haishima, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 0 days.

(21) Appl. No.: 17/428,057

(22) PCT Filed: Jan. 30, 2020

(86) PCT No.: PCT/JP2020/003343
§ 371 (c)(1),
(2) Date: Aug. 3, 2021

(87) PCT Pub. No.: WO2020/162301
PCT Pub. Date: Aug. 13, 2020

(65) Prior Publication Data

US 2022/0148360 A1 May 12, 2022

(30) Foreign Application Priority Data

Feb. 4, 2019 (JP) ..... JP2019-018037

(51) Int. Cl.
*G07D 11/24* (2019.01)
*G07D 11/12* (2019.01)
(Continued)

(52) U.S. Cl.
CPC ..... *G07D 11/24* (2019.01); *G07D 11/12* (2019.01); *G07D 11/60* (2019.01); *G07D 2211/00* (2013.01); *G07F 17/3246* (2013.01)

(58) Field of Classification Search
CPC ..... G07D 11/24; G07D 11/12; G07D 11/60; G07D 2211/00; G07F 17/3246
See application file for complete search history.

(56) References Cited

U.S. PATENT DOCUMENTS

2008/0085752 A1* 4/2008 Okada ..... G07F 17/32 463/20
2013/0172071 A1* 7/2013 Tarantino ..... G07F 17/3218 463/25
2014/0349742 A1* 11/2014 Takeda ..... G06Q 20/0457 463/25

FOREIGN PATENT DOCUMENTS

JP 2004318518 A * 11/2004
JP 2005018644 A 1/2005
(Continued)

OTHER PUBLICATIONS

JP2018036807A Cash Operational Management System, English machine translation, 14 pages. (Year: 2022).*
(Continued)

*Primary Examiner* — Tuyen K Vo
(74) *Attorney, Agent, or Firm* — United IP Counselors, LLC; Kenneth Fagin

(57) ABSTRACT

An object of the present invention is to provide a banknote processing system capable of easily specifying a banknote processing terminal which accommodates banknotes of a particular currency in a container. In a banknote processing system 1000, a slot machine G10 is configured to read to which currency type an accommodated banknote T belongs and to send a currency type signal to a management server 260 configured to store location information specifying an installation location of each of slot machines G10, to store the slot machine G10 which has sent the currency type signal, in association with a currency type indicated by the currency type signal, to specify the slot machine G10 associated with a predetermined currency type, and to present the installation location of the specified slot machine G10.

6 Claims, 9 Drawing Sheets

(51) Int. Cl.

| | |
|---|---|
| ***G07D 11/50*** | (2019.01) |
| ***G07D 11/60*** | (2019.01) |
| *G07F 17/32* | (2006.01) |

(56) References Cited

FOREIGN PATENT DOCUMENTS

| | | | | |
|---|---|---|---|---|
| JP | 2007065875 | A | | 3/2007 |
| JP | 2010072748 | A | * | 4/2010 |
| JP | 2013073538 | A | | 4/2013 |
| JP | 2013088896 | A | * | 5/2013 |
| JP | 2017173898 | A | | 9/2017 |
| JP | 2018036807 | A | | 3/2018 |
| WO | 2017168752 | A1 | | 10/2017 |

OTHER PUBLICATIONS

JP2010072748A Money-Handling Device, English machine translation, 8 pages (Year: 2022).*
Jp2013088896A, Automated Cash Transaction Device and Currency Management Method, 19 pages (Year: 2022).*
International Search Reported dated Mar. 3, 2020, issued in International Application No. PCT/JP2020/003343.
Written Opinion dated Mar. 3, 2020, issued in International Application No. PCT/JP2020/003343.

* cited by examiner

FIG.4

ACCOMMODATED CURRENCY TYPE TABLE

| LOCATION INFORMATION | STACKER IDENTIFICATION INFORMATION | CURRENCY TYPE | BANKNOTE TYPE | NUMBER OF BANKNOTES |
|---|---|---|---|---|
| ... | ... | ... | ... | ... |
| A0011 | 00153262 | USD | 100 | 7 |
| A0012 | 52012354 | HKD | 100 | 8 |
| A0012 | 52012354 | HKD | 500 | 2 |
| A0012 | 52012354 | USD | 50 | 5 |
| A0013 | 00002623 | PHP | 100 | 12 |
| A0013 | 00002623 | PHP | 200 | 7 |
| A0013 | 00002623 | PHP | 500 | 2 |
| ... | ... | ... | ... | ... |

BANKNOTE PROCESSING SYSTEM

TECHNICAL FIELD

The present invention relates to a banknote processing system.

BACKGROUND

Banknote processing devices are, for example, embedded in service equipment, a gaming machine installed in a gaming facility, and a vending machine or a ticket machine installed in a public place, each of which is configured to identify the validity of a banknote inserted into an insertion slot by users, and which provide a service or product in accordance with the value of a banknote which is identified to be valid. Such a banknote processing device is typically arranged to identify the validity of a banknote inserted through the insertion slot and to accommodate a valid banknote in a detachable container (safe). Banknotes are typically collected in such a way that the container accommodating the banknotes is detached from the banknote processing device and another container is attached to it. Such a banknote processing device is connected to, e.g., a gaming machine such as a slot machine. This gaming machine runs a game based on a banknote received by the banknote processing device.

In the banknote processing device, as disclosed in Patent Literature 1, for example, a storage unit is provided in the container to check if an inserted banknote is matched with a banknote actually accommodated in the container. To be more specific, a banknote identification control circuit board is provided in a banknote identifier on the device main body side whereas a banknote container control circuit board is provided on the container side, and these circuit boards are arranged to communicate with each other via a connector terminal. To put it differently, information regarding an inserted banknote is sent from the banknote identification control circuit board to the banknote container control circuit board and the banknote information is stored in the storage unit mounted on the board, with the result that the information of a banknote actually accommodated in the container is stored and managed.

CITATION LIST

Patent Literatures

[PLT 1] Japanese Unexamined Patent Publication No. 2005-18644

SUMMARY OF INVENTION

Technical Problem

With increase of travelers and sojourners from foreign countries, banknote processing devices are increasingly required to accept foreign currencies. For example, in order to enable not only the play with a local currency which is set for gaming machines but also the play with foreign currencies, the banknote processing devices connected to the gaming machines are required to accept foreign currencies in addition to a local currency. In order to achieve this, one banknote processing device is supposed to accommodate banknotes of a variety of currencies including a currency circulated in one country or region where the banknote processing device is provided and currencies circulated in other countries or regions. A gaming facility where a plurality of banknote processing devices capable of accepting a variety of currencies are provided, however, may require many people and much time for the known banknote processing devices described above when it is necessary to specify a banknote processing terminal which accepts a specific currency among a variety of currencies and to collect banknotes of this specific foreign currency. In regard to banknote processing devices capable of dealing with foreign currencies, some countries require daily replacement of banknotes, and this may lead to difficulty in managing the banknote processing devices in which banknotes of foreign currencies are accommodated.

Therefore, an object of the present invention is to provide a banknote processing system that can solve all the above-mentioned problems.

Solution to Problem

A banknote processing system of the present invention includes:

at least one banknote processing terminal including a reader unit configured to read to which currency type a banknote inserted into an insertion slot belongs, an accommodation unit configured to accommodate the banknote from which a currency type is read by the reader unit, and a banknote type transmitter configured to send a currency type signal indicating the currency type which is read by the reader unit to the outside; and an external device including a location information storage unit which stores location information specifying an installation location of each of the at least one banknote processing terminal, an external-device-side receiver configured to receive the currency type signal from the at least one banknote processing terminal, an accommodated currency type storage unit which stores the at least one banknote processing terminal which has sent the received currency type signal, in association with the currency type indicated by the currency type signal, a banknote processing terminal specifying unit configured to specify the at least one banknote processing terminal associated with a predetermined currency type, and a presentation unit configured to present the installation location of the at least one banknote processing terminal specified by the banknote processing terminal specifying unit.

With this arrangement, the banknote processing terminal reads the currency type of the banknote which is to be accommodated, and sends the currency type signal based on this currency type to the external device. The currency type indicated by the currency type signal is stored into the external device, in association with the banknote processing terminal. The banknote processing terminal associated with the predetermined currency type is specified and presented in association with the installation location of the banknote processing terminal, which is stored in advance. As a result, because the installation location of the banknote processing terminal which accommodates banknotes of the predetermined currency type is presented, the banknote processing terminal which accommodates banknotes of a particular currency in a container is easily specified.

In the banknote processing system of the present invention, the accommodated currency type storage unit may store the number of banknotes accommodated by the at least one banknote processing terminal for each currency type based on the currency type signal, and the presentation unit may present the installation location of each of the at least one banknote processing terminal in which the number of accommodated banknotes of the predetermined currency type is equal to or more than a threshold.

With this arrangement, the external device stores the number of banknotes for each currency type in association with the banknote processing terminal based on the currency type signal, and presents only the banknote processing terminal in which the number of accommodated banknotes of the currency type is equal to or more than a predetermined threshold. Because of this, an administrator who manages the banknote processing terminal can easily identify the banknote processing terminal in which the number of accommodated banknotes of the predetermined currency type is equal to or more than the threshold.

In the banknote processing system of the present invention, the external device may further include a currency type receiving unit configured to receive any designation of one currency type, and the banknote processing terminal specifying unit may specify the at least one banknote processing terminal associated with the one currency type the designation of which is received by the currency type receiving unit.

With this arrangement, when the designation of the currency type is received in the external device, the banknote processing terminal associated with this currency type is specified. With this arrangement, because the banknote processing terminal which accommodates banknotes of the designated currency type is specified, the installation location of the specified banknote processing terminal is presented. As a result, because the installation location of the banknote processing terminal which accommodates banknotes of the designated currency type is presented, the banknote processing terminal which accommodates banknotes of the designated currency type is easily specified.

BRIEF DESCRIPTION OF DRAWINGS

FIG. 4 is an explanatory diagram of an accommodated currency type table.

PREFERRED EMBODIMENT OF INVENTION

Figure 1:
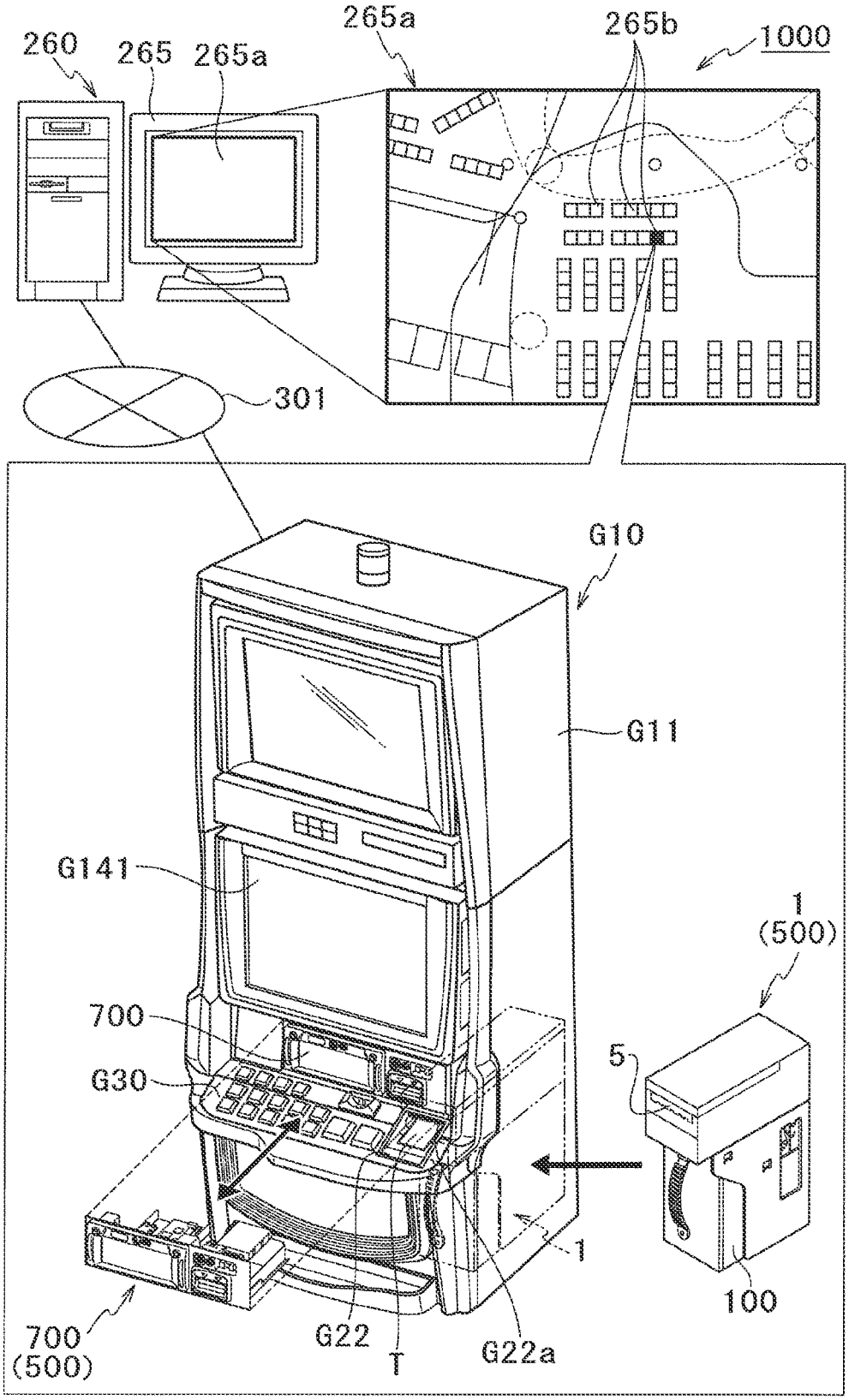
FIG. 1 illustrates the outline of a banknote processing system.

As shown in FIG. 1, a banknote processing system 1000 of the present embodiment includes a banknote processing terminal 500 and a management server 260 which is an external device.

In the present embodiment, the banknote processing terminal 500 includes a banknote processing device 1 capable of reading a currency type of an inserted banknote T and storing the banknote T and a PTS terminal 700 configured to send the read currency type to the management server 260 by data communication. In the present embodiment, a slot machine G10 includes therein the banknote processing device 1 and the PTS terminal 700 which embody functions of the banknote processing terminal 500, and the slot machine G10 functions as a gaming machine configured to run a game. While the slot machine G10 of the present embodiment includes the banknote processing terminal 500 as described above, the disclosure is not limited to this. For example, the banknote processing terminal 500 may be formed and provided to be independent from the slot machine G10.

In the present embodiment, the PTS terminal 700 provided in the banknote processing terminal 500 embedded in each of slot machines G10 in a gaming facility is connected to the management server 260 through a communication line 301 in a data communicable manner. The disclosure is not limited to this, and the PTS terminal 700 provided in the banknote processing terminal 500 embedded in each of slot machines G10 which are provided in each of gaming facilities may be connected to the management server 260 in a data communicable manner.

The slot machine G10 has a cabinet G11, and the cabinet G11 has a bill entry G22 having an insertion slot G22*a* through which banknotes from the outside are received. Banknotes T are therefore received by the banknote processing device 1 through the insertion slot G22*a* of the bill entry G22.

The banknote processing device 1 is embedded in the slot machine G10, and is provided in the cabinet G11 so that a banknote insertion slot 5 corresponds to the insertion slot G22*a* of the bill entry G22. In this way, the banknote processing device 1 receives a banknote T inserted through the insertion slot 22*a* of the bill entry 22. That is, the banknote processing device 1 is embedded in the slot machine G10 so that banknotes T can be inserted into the banknote insertion slot 5 from the outside.

The banknote processing device 1 is detachably provided in the cabinet G11 of the slot machine G10. The banknote processing device 1 includes a banknote accommodation unit (banknote stacker) 100 which is an accommodation unit in which banknotes T inserted into the banknote insertion slot 5 which is an insertion slot are accommodated. The banknote processing device 1 reads to which one of currency types an inserted banknote T belongs.

A banknote conveyance mechanism included in the banknote processing device 1 may be a known banknote conveyance mechanism. Although not illustrated, a banknote received by the banknote processing device 1 is conveyed by the banknote conveyance mechanism included in the banknote processing device 1 and is accommodated in a banknote accommodation unit 100. The banknote accommodation unit 100 has a function as a safe capable of stacking and accommodating a large number of banknotes, and is detachably attached to the banknote processing device 1. That is, when the number of banknotes accommodated in the banknote accommodation unit 100 reaches the maximum number, the banknote accommodation unit 100 is detached from the banknote processing device 1 embedded in the slot machine G10, and another banknote accommodation unit 100 in which no banknote is accommodated is attached to the banknote processing device 1. This shortens time required for maintenance of the slot machine G10 and prevents the decrease in operation rate.

Banknotes are a type of currencies. The term "currency" encompasses not only legal currencies issued by governments but also local currencies each used in a particular community and international currencies transacted internationally, such as Euro and United States Dollar. The term "currency circulation zone" indicates a geographical range in which the currency is used for transaction. For example, in case of a currency circulated in a country, the range within the border of the country is the currency circulation zone. In case of a common currency circulated in an area constituted by a plurality of countries, the area is the currency circulation zone. Furthermore, in case of a currency circulated in a region of a country, the region is the currency circulation zone.

The PTS terminal 700 is provided in the slot machine G10 and between a game image display panel G141 which displays game images and a control panel G30 on which members such as buttons for controlling a game and the above-described bill entry G22 are provided. The PTS terminal 700 is inserted into the cabinet G11 from the front surface side of the slot machine G10 and is embedded in the slot machine G10 so as to form a part of the front surface of the cabinet G11. The PTS terminal 700 is arranged to perform mediation in data communications between devices in the banknote processing system 1000. To be more specific, the PTS terminal 700 is connected to each of the banknote processing device 1 and a game controller G100 controlling processes executed by the slot machine G10, to be able to perform data communication with each of the connected devices. Further, the PTS terminal 700 is connected to the management server 260 through the communication line 301.

Although not illustrated, the PTS terminal 700 includes an LCD, a touch panel, a human body detection camera, a microphone, a speaker, and a card insertion slot. Specifically, the LCD displays information regarding the game, exchange rates, and the like. The touch panel is provided on the LCD to cause the PTS terminal 700 to function as an input device capable of receiving an operation input from the outside. The human detection camera detects the presence of a player by a camera function. The microphone is used for allowing a player to participate in a game through input of player's voice and for authenticating a player by voice recognition. The speaker performs effects in a game by sound, and outputs various types of notification sound. The card insertion slot has a mechanism which allows an IC card such as a member card of a player of a game to be inserted and removed. These members are controlled by a later-described smart interface board 710. The smart interface board 710 connected to the above-described members is a control board configured to control the members, and controls sending and receiving of signals to and from the outside.

The PTS terminal 700 sends a currency type signal indicating a currency type read from a banknote T by the banknote processing device 1, to the management server 260. In this regard, a currency type signal includes identification information for identifying the slot machine G10. This identification information is information for identifying at least one of the slot machine G10, the banknote processing device 1, the PTS terminal 700, and the banknote accommodation unit 100. A currency type signal may further include a time of receiving the banknote T, an installation location of the slot machine G10, a banknote type, an exchange rate, etc. In this regard, a banknote type is information indicating the type of each banknote, e.g., 50 dollars or 100 dollars in a case of US dollars. An exchange rate is a rate of exchange between a currency of a received banknote T and a currency circulated in the currency circulation zone where the slot machine G10 is provided. In the following description, a currency of a received banknote T and a currency circulated in the currency circulation zone where the slot machine G10 is provided may be referred to as a local currency.

The PTS terminal 700 may send a currency type to the management server 260 each time the banknote processing device 1 reads the currency type from a banknote T. Alternatively, the PTS terminal 700 may send a currency type signal to the management server 260 at every predetermined time. Alternatively, the PTS terminal 700 may send a currency type signal to the management server 260 in response to a request from the management server 260.

The slot machine G10 may be configured to temporarily store or to accumulatively store a currency type which is read from a banknote T by the banknote processing device 1. In this regard, a currency type may be stored in any of the slot machine G10, the banknote processing device 1, and the PTS terminal 700.

While in the present embodiment a currency type signal indicating a currency type which is read from a banknote T by the banknote processing device 1 is sent to the management server 260 via the PTS terminal 700, the disclosure is not limited to this. For example, a currency type signal indicating a currency type which is read from a banknote T by the banknote processing device 1 may be sent to the slot machine G10 via the PTS terminal 700. Subsequently, information based on this currency type signal may be sent from the slot machine G10 to the management server 260 via the PTS terminal 700.

While the banknote processing terminal 500 of the present embodiment is connected to the slot machine, the disclosure is not limited to this. For example, the gaming machine may be a gaming table used for poker, etc. When the gaming machine includes plural terminals, the terminals may be connected to different banknote processing terminals, respectively. Each banknote processing terminal is not limited to be connected to the gaming machine, and may be connected to, e.g., a money exchanger, a vending machine, and a ticket machine.

The management server 260 is a computer, and includes a later-described center controller 261 configured to execute various functions and a display 265. The management server 260 stores location information specifying an installation location of each of banknote processing terminals 500 which are connected with one another to be able to perform data communication. In this regard, location information is information in which an address indicating a position in a gaming facility is associated with identification information identifying the banknote processing terminal 500. This location information may be stored in the management server 260 in advance at the time of installation of the banknote processing terminal 500, or may be included in a currency type signal. When the information is included in a currency type signal, each banknote processing terminal 500 is supposed to store location information indicating the installation location of that banknote processing terminal 500. In the present embodiment, because the banknote processing terminal 500 is embedded in the slot machine G10, a position of the banknote processing terminal 500 is identical to a position of the slot machine G10 connected to the banknote processing terminal 500. That is, when there is a device connected to the banknote processing terminal 500, location information of that device may be used as location information of the banknote processing terminal 500. In the following description, the banknote processing terminal 500 may be regarded as the slot machine G10.

The management server 260 stores accommodated currency type information in which the banknote processing terminal 500 is associated with a currency type, based on a currency type signal sent from each banknote processing terminal 500 which is connected to be able to perform data communication. That is, accommodated currency type information is information indicating which type a banknote T accommodated by the banknote processing terminal 500 is. Based on the accommodated currency type information, the management server 260 specifies in which banknote processing terminal 500 banknotes of a predetermined currency type are accommodated and then presents an installation location of the specified banknote processing terminal 500.

In this regard, the predetermined currency type may be one currency type or may be currency types (foreign currencies) except a currency type in the currency circulation zone where the slot machine G10 is provided.

In the present embodiment, the management server 260 shows an installation location of the specified slot machine G10 (i.e., banknote processing terminal 500) onto a display screen 265*a* of the display 265. To be more specific, the management server 260 displays, as the display screen 265*a*, a map showing a bird's-eye view of the gaming facility in which the slot machine G10 connected to the management server 260 in a data communicable manner is provided, on the display 265. On the display screen 265*a*, a banknote processing terminal object 265*b* indicating each slot machine G10 is displayed. Then, the management server 260 recognizably presents a position of the slot machine G10 which accommodates banknotes of a predetermined currency type on the display screen 265*a*. In the present embodiment, the management server 260 displays the slot machine G10 which accommodates banknotes of a predetermined currency type into the banknote processing device 1, on the display screen 265*a* in a different color from other slot machines G10 which do not accommodate banknotes of a predetermined currency type into the banknote processing device 1. However, the disclosure is not limited to this.

As such, the slot machine G10 of the present embodiment includes the following members: the banknote processing device 1 configured to read to which currency type a banknote T inserted through the banknote insertion slot 5 belongs, to store the read currency type, and to accommodate the banknote T from which the currency type is read into the banknote accommodation unit 100; and the PTS terminal 700 configured to send a currency type signal indicating the currency type which is read by the banknote processing device 1 to the management server 260. The management server 260 is configured to store location information specifying an installation location of each of slot machines G10, to receive a currency type signal from the slot machine G10, to store the slot machine G10 which sends the received currency type signal and which is associated with a currency type indicated by the currency type signal, to specify the slot machine G10 associated with a predetermined currency type, and to present an installation location of the specified slot machine G10.

That is, the slot machine G10 reads a currency type of a banknote which is to be accommodated, and sends a currency type signal based on the currency type to the management server 260. The currency type indicated by the currency type signal is associated with the slot machine G10 and is stored into the management server 260. The slot machine G10 associated with the predetermined currency type is specified and presented in association with an installation location of the slot machine G10 which is stored in advance. As a result, because the installation location of the slot machine G10 which accommodates banknotes of the predetermined currency type is presented, the slot machine G10 which accommodates banknotes of a specific currency in the banknote accommodation unit 100 of the banknote processing device 1 is easily specified.

Figure 2:
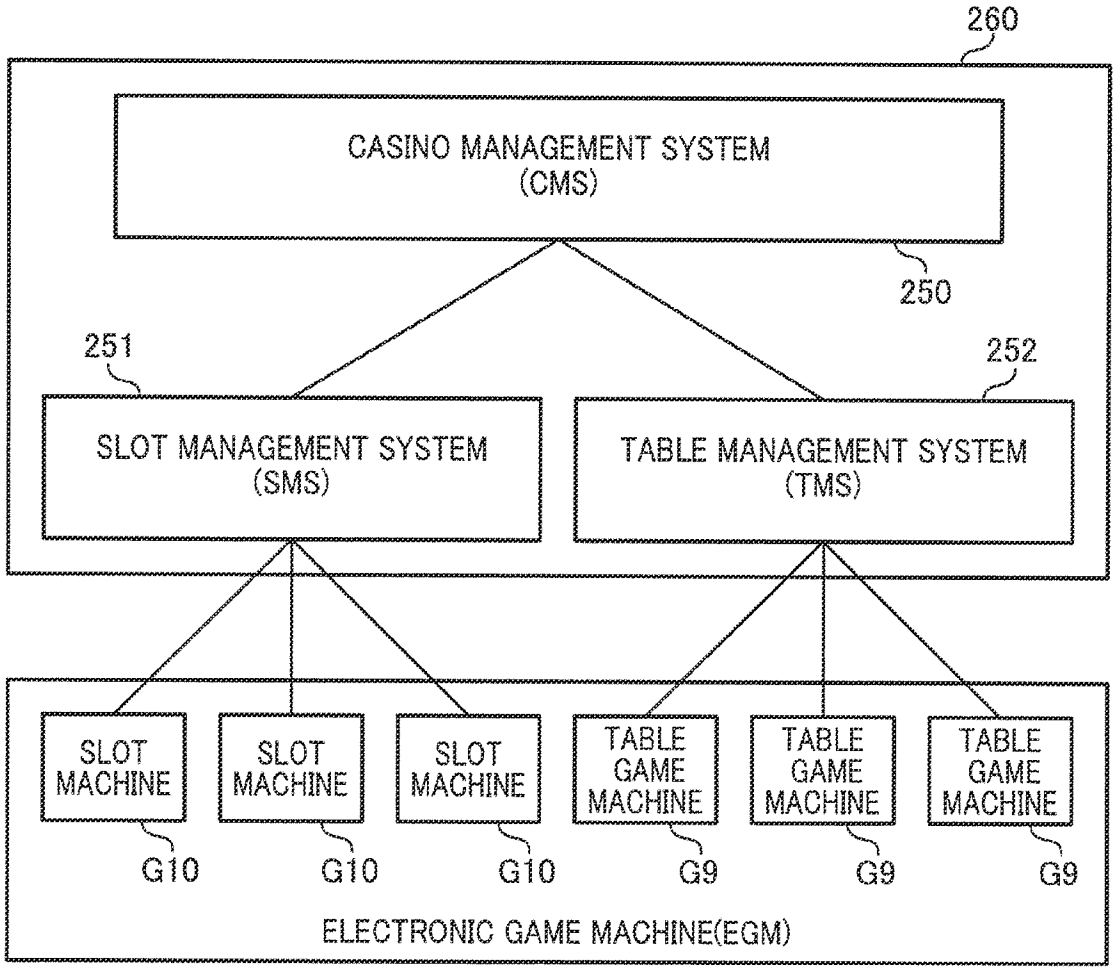
FIG. 2 is a block diagram of the functional configuration of a management server.

The following will describe the functional configuration of the management server 260 of the present embodiment, with reference to FIG. 2. As shown in FIG. 2, the management server 260 includes a casino management system 250, a slot machine management system 251, and a table management system 252. The slot machine management system 251 is connected to a plurality of slot machines G10 in a data communicable manner, and has a function of receiving and totaling sales information such as bet information and payout information from each slot machine G10.

The table management system 252 is connected to a plurality of table game machines G9 other than slot machines G10 in a data communicable manner. Although not specifically described, each table game machine G9 is an electronic game machine (EGM) capable of executing table games such as poker, baccarat, and roulette and functions as a banknote processing terminal similar to each slot machine G10 in the present embodiment. The table management system 252 has a function of receiving and totaling sales information such as bet information and payout information from each slot machine G9.

The casino management system 250 is a system configured to control all gaming machines managed by the management server 260, and has a function of managing sales information totaled up by the slot machine management system 251 and the table management system 252. The casino management system 250 also has a function, which is related to exchange rates, such as a function of receiving an input regarding exchange rates of plural foreign currencies and a function of sending an exchange rate to each slot machine G10.

An input regarding exchange rates of plural foreign currencies is manually made into the casino management system 250 by, e.g., an administrator who is allowed to set exchange rates. However, the disclosure is not limited to this. The casino management system 250 may have a function of obtaining exchange rates of plural foreign currencies from, e.g., a server configured to manage exchange rates. The exchange rates are applied at a predetermined timing, and are sent to the slot machine G10 via the slot machine management system 251 and to the table game machine G9 via the table management system 252.

In the present embodiment, foreign currencies are exchanged by the PTS terminal 700 in the slot machine G10. That is, when the banknote processing device 1 receives a piece of a foreign currency from a user, the PTS terminal 700 of the slot machine G10 obtains an exchange rate regarding this piece of the foreign currency from the casino management system 250 via the slot machine management system 251 and exchanges the received foreign currency for a local currency. In this regard, the word "exchange" refers to a process of associating a user with data indicating a physical local currency which is converted from a foreign currency. However, the disclosure is not limited to this. For example, the process of associating a user corresponds to a process of writing data indicating the converted local currency into an IC card inserted into the PTS terminal 700 and a process of adding data indicating the converted local currency to the money owned by a user who performed the exchange in a server configured to manage the money of the user.

While in the embodiment above exchange is done by the PTS terminal 700 of the slot machine G10, exchange may be done by the casino management system 250 or the slot machine management system 251. That is, the slot machine G10 sends information (currency type, amount, etc.) regarding a foreign currency to the management server 260, and the management server 260 executes exchange based on the set exchange rate and sends information including the monetary amount of a local currency after the exchange back to the slot machine G10.

In the present embodiment, the management server 260 has functions of the casino management system 250, the slot machine management system 251, and the table management system 252. However, the disclosure is not limited to this. For example, when the management server 260 manages only the slot machine G10, the management server 260 may be arranged not to include the table management system 252. In this case, the slot machine management system 251 may have a function of the casino management system 250. That is, the slot machine management system 251 may have functions such as a function of receiving an input regarding exchange rates of plural foreign currencies and a function of sending an exchange rate to each slot machine G10. The management server 260 is not limited to one server device, and may be provided as plural devices.

The following will describe an electrical configuration of the banknote processing system 1000 of the present embodiment.

Figure 3:
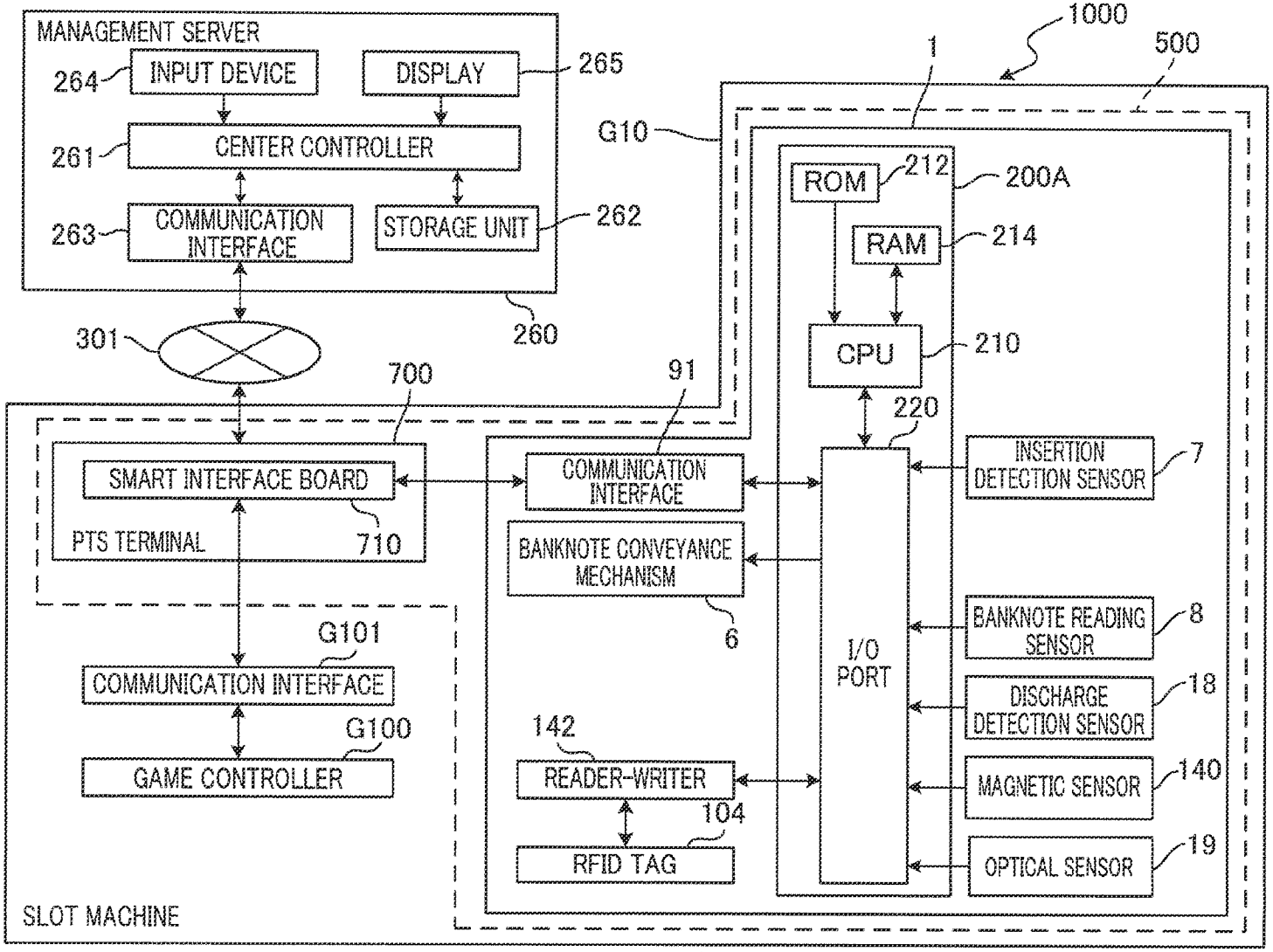
FIG. 3 is a block diagram of the electrical configuration of the banknote processing system.

To begin with, the electrical configuration of the banknote processing system 1000 will be described with reference to the block diagram in FIG. 3. As shown in FIG. 3, in the slot machine G10 of the banknote processing system 1000, the banknote processing terminal 500 including the banknote processing device 1 and the PTS terminal 700 is connected to the management server 260 through the communication line 301. To be more specific, each of the banknote processing device 1 and the game controller G100 is connected to the PTS terminal 700, and the PTS terminal 700 is connected to the management server 260 through the communication line 301.

The banknote processing device 1 includes a control circuit board 200A, and the control circuit board 200A has thereon a CPU (Central Processing Unit) 210, a ROM (Read Only Memory) 212, a RAM (Random Access Memory) 214, and an I/O port 220.

The CPU 210 is connected to a banknote conveyance mechanism 6 through the I/O port 220. The banknote conveyance mechanism 6 allows banknotes having been inserted through the banknote insertion slot 5 to be conveyed along the insertion direction, allows banknotes being inserted to be sent back toward the banknote insertion slot 5, and allows banknotes being inserted to be accommodated into a banknote accommodation unit 100. Although not illustrated, the banknote conveyance mechanism 6 includes a conveyance roller conveying banknotes, a driving source such as a motor configured to drive the conveyance roller, and sensors configured to detect a state of conveyed banknotes and a state of banknotes in the banknote accommodation unit 100. The CPU 210 drives and controls the driving source based on detection signals from these sensors. Through the I/O port 220, the CPU 210 is connected to an insertion detection sensor 7 configured to detect banknotes having been inserted through the banknote insertion slot 5, a banknote reading sensor 8 configured to read information of banknotes being conveyed in the banknote conveyance mechanism 6, a discharge detection sensor 18 configured to detect banknotes being discharged into the banknote accommodation unit 100, a magnetic sensor 140 configured to detect whether banknotes accommodated in the banknote accommodation unit 100 reach a predetermined number, and an optical sensor 19 configured to detect the banknote accommodation unit 100 being attached or detached.

In the ROM 212, the following sets of data are stored: programs such as an actuation program of driving devices configured to control the banknote conveyance mechanism 6 and a verification program regarding banknotes which are read by the banknote reading sensor 8; and permanent data. The CPU 210 generates control signals according to the programs stored in the ROM 212, inputs and outputs signals to and from the above-described banknote conveyance mechanism 6 through the I/O port 220, and drives and controls the driving devices. The ROM 212 further stores reference data used for determining the validity of banknotes, e.g., sets of data obtained from the entire print region of a valid banknote (e.g., data regarding light and shade and data regarding transmitted light and reflected light when infrared light is applied to a banknote). The RAM 214 stores data and a program used in operation of the CPU 210. The RAM 214 further stores information such as banknote information which is stored in a later-described RFID tag 104 and which is read from banknotes and identification information by which the attached banknote accommodation unit 100 is identified. The identification information by which the banknote accommodation unit 100 is identified is stored in the RFID tag 104 of the banknote accommodation unit 100 in advance, and is stored in the RAM 214 when the banknote accommodation unit 100 is attached.

The CPU 210 is connected to the banknote reading sensor (e.g., line sensor) 8 through the I/O port 220 as described above, banknote reading data which is read from a banknote by the banknote reading sensor 8 is compared with the reference data stored in the ROM 212, and a verification process of verifying the banknote is executed. The banknote reading sensor 8 reads a currency type and monetary amount of a banknote from the banknote received by the banknote processing device 1.

The CPU 210 sends, through the I/O port 220, banknote information regarding a banknote which is determined as a valid banknote to a reader-writer 142. To put it differently, the CPU 210 compares data of a banknote read by the banknote reading sensor 8 with the reference data stored in a reference data storage unit 216. When the verification process of verifying the banknote is executed and the banknote is determined as a valid banknote, the CPU 210 activates the reader-writer 142 to write the information of the valid banknote in the RFID tag 104 in the banknote accommodation unit 100.

In this case, in addition to the banknote information (e.g., monetary amount information) of the accommodated banknote, time information indicating the time of insertion of the banknote and unique ID information of a device main body 2 may be stored in the RFID tag 104, in association with the banknote information. To be more specific, for example, when the banknote accommodation unit 100 is attached to the device main body 2, the unique ID information assigned to the device main body 2 of the banknote processing device 1 in advance is written into a storage unit 104*b* of the RFID tag 104 to associate the device main body 2 with the banknote accommodation unit 100.

The I/O port 220 is connected to a communication interface 91. The communication interface 91 is connected to the smart interface board 710 of the PTS terminal 700 to be able to send data to and receive data from the PTS terminal 700. The banknote processing device 1 sends, via the communication interface 91, a banknote information signal based on banknote information read from a banknote by the banknote reading sensor 8 to the PTS terminal 700.

The slot machine G10 includes the game controller G100 which controls the control panel G30 and the game image display panel G141 described above and which runs a game. Although not illustrated, the game controller G100 includes a CPU, a ROM, a RAM, and an I/O port to which members such as the control panel G30 and the game image display panel G141 are connected. The game controller G100 is connected to a communication interface G101 to be able to send data to and receive data from the PTS terminal 700. Through the communication interface G101, the slot machine G10 sends a game result and game information such as the content of a bet on a game to the PTS terminal 700.

In the slot machine G10, when the game controller G100 receives banknote information from the banknote processing device 1 through the PTS terminal 700, based on monetary amount information in the banknote information, the game controller G100 executes a process related to a game such as addition of a credit equivalent to a monetary amount indicated by the monetary amount information to a credit owned by a player. The game controller G100 determines the content of the bet based on an input to the control panel G30 by the player, subtracts a credit indicated by the content of the bet from the owned credit, and starts the game based on the content of the bet.

The PTS terminal 700 includes the smart interface board 710 which controls the LCD, the touch panel, the human detection cameras, the microphones, and the speakers described above and which controls sending and receiving of signals to and from the outside. Although not illustrated, the smart interface board 710 includes a CPU, a GPU, a ROM, a RAM, and a communication interface by which communications under various standards with the outside are realized. Non-limiting examples of the communication standards supported by the smart interface board 710 include RS232C, RS485, optical isolation, and USB. The smart interface board 710 has a function as an Ethernet (registered trademark) controller and is arranged to be able to communicate with the management server 260 through the communication line 301.

In the PTS terminal 700, the smart interface board 710 has a function as a banknote type transmitter configured to send a currency type signal to the management server 260 when receiving the currency type signal from the banknote processing device 1. Furthermore, the smart interface board 710 has a function of sending banknote information to the slot machine G10 when receiving the banknote information from the banknote processing device 1. Furthermore, the smart interface board 710 has a function of sending game information to the management server 260 when receiving the game information from the slot machine G10. Although not illustrated, when a banknote received by the banknote processing device 1 is determined as a foreign currency, the PTS terminal 700 configured to be able to obtain exchange rates of plural currency types from the outside calculates a corresponding credit amount on the premise that the banknote is exchanged for a currency circulated in a circulation zone where the slot machine G1 is provided, and sends the credit amount to the slot machine G10.

The management server 260 is a computer and includes members such as the center controller 261, a storage unit 262 storing information supplied from the PTS terminal 700, etc., a communication interface 263 by which sending and receiving of signals to and from the outside are realized, an input device 264, and the display 265. Although not illustrated, the center controller 261 includes a CPU, a ROM, a RAM, and an I/O port to which members such as the storage unit 262 and the communication interface 263 are connected. The input device 264 is not limited to a mouse, keyboard, and the like connected to the management server 260, and may be a terminal connected so as to enable remote operation or the registration and modification of data. The center controller 261 controls the storage unit 262, the communication interface 263, the display 265, and the like based connected to the controller 261, on an input from the input device 264 and a signal from the slot machine G10.

To be more specific, in the management server 260, the center controller 261 receives a currency type signal from each of slot machines G10 via the communication interface 263. That is, the center controller 261 and the communication interface 263 function as an external-device-side receiver configured to receive a currency type signal from the slot machine G10.

In the management server 260, the center controller 261 receives a currency type signal from each of slot machines G10 via the communication interface 263. That is, the center controller 261 and the communication interface 263 function as an external-device-side receiver configured to receive a currency type signal from the slot machine G10.

In the management server 260, the center controller 261 stores location information specifying an installation location of each of slot machines G10 into the storage unit 262 based on an input from the input device 264. That is, the center controller 261 and the storage unit 262 function as a location information storage unit configured to store location information specifying an installation location of each of slot machines G10. Based on a currency type signal from the slot machine G10, the center controller 261 stores the slot machine G10 which sends the received currency type signal and a currency type indicated by the currency type signal in association with each other into the storage unit 262 in the management server 260. That is, the center controller 261 and the storage unit 262 function as an accommodated currency type storage unit configured to store the slot machine G10 which sends a received currency type signal and a currency type indicated by the currency type signal in association with each other.

Based on the association between a slot machine G10 and a currency type indicated by a currency type signal which are stored in the storage unit 262, the center controller 261 specifies a slot machine G10 associated with a foreign currency in the management server 260. That is, the center controller 261 and the storage unit 262 function as a banknote processing terminal specifying unit configured to specify the slot machine G10 associated with a predetermined currency type.

In the management server 260, the center controller 261 displays a map which presents an installation location of the specified slot machine G10 on the display 265, as the display screen 265*a*. That is, the center controller 261 and the display 265 function as a presentation unit configured to present an installation location of the specified slot machine G10. In this regard, an installation location of the specified slot machine G10 may be displayed on, e.g., a tablet terminal owned by a staff in the gaming facility. In this case, the center controller 261 sends a signal indicating an installation location of the specified slot machine G10 to the tablet terminal owned by the staff in the gaming facility.

In the present embodiment, the storage unit 262 stores the number of banknotes accommodated by the slot machine G10 for each currency type based on a currency type signal. When a predetermined threshold is set, the center controller 261 presents an installation location of the slot machine G10 in which the number of accommodated banknotes of a predetermined currency type is equal to or more than a predetermined threshold.

As such, the management server 260 stores the number of banknotes for each currency type in association with the slot machine G10 based on a currency type signal, and presents only the slot machine G10 in which the number of received banknotes of a currency type is equal to or more than a predetermined threshold. Because of this, an administrator who manages slot machines G10 can easily identify the slot machine G10 in which the number of accommodated banknotes of a predetermined currency type is equal to or more than a threshold.

Based on the designation of one of currency types which is from the outside and which is received by the input device 264, the center controller 261 specifies the slot machine G10 associated with the designated currency type. That is, the input device 264 functions as a currency type receiving unit configured to receive the designation of one of currency types. When receiving the designation of a currency type, the center controller 261 presents the slot machine G10 which accommodates banknotes of the currency type on the display screen 265*a*.

As such, when the designation of a currency type is received in the management server 260, the slot machine G10 associated with the currency type is specified. With this arrangement, because the slot machine G10 which accommodates banknotes of the designated currency type is specified, an installation location of the specified slot machine G10 is presented. As a result, because an installation location of the slot machine G10 which accommodates banknotes of the designated currency type is presented, the slot machine G10 which accommodates banknotes of the designated currency type is easily specified.

The following will describe a data table stored in the storage unit 262 of the management server 260 in the present embodiment.

To begin with, an accommodated currency type table stored in the storage unit 262 will be described with reference to FIG. 4.

The accommodated currency table stores each slot machine G10 which sends a currency type signal to the management server 260, in association with location information indicating an installation location where the slot machine G10 is provided. In addition to that, the accommodated currency type table stores each slot machine G10 in association with a currency type indicated by a currency type signal.

To be more specific, the accommodated currency type table has a location information column, a stacker identification information column, a currency type column, a banknote type column, and a number column.

The location information column stores location information for identifying an installation location where each slot machine G10 is provided. The stacker identification information column stores a unique number for identifying each of all managed banknote accommodation units 100. That is, each slot machine G10 is identified by the banknote accommodation unit 100 attached to the banknote processing device 1. The currency type column stores each currency type of banknotes accommodated in the banknote accommodation unit 100. The banknote type column stores information indicating a money type existing for each currency type. The number column stores, for each banknote type, the number of banknotes which are accommodated by one banknote accommodation unit 100.

In the example of FIG. 4, the slot machine G10 indicated by the stacker identification information "52012354" is provided at the installation location indicated by the location information "A0011", and the banknote accommodation unit 100 of the banknote processing device 1 in this slot machine G10 accommodates eight HK $100 banknotes, two HK $500 banknotes, and five US $50 banknotes. In addition to that, the slot machine G10 indicated by the stacker identification information "0002623" is provided at the installation location indicated by the location information "A0013", and the banknote accommodation unit 100 of the banknote processing device 1 in this slot machine G10 accommodates twelve PH $100 banknotes, seven PH $200 banknotes, and five PH $500 banknotes.

That is, when the gaming facility including slot machines G10 is located in Philippines and a foreign currency is set as a predetermined currency, an installation location of the slot machine G10 indicated by the stacker identification information "52012354" is presented while an installation location of the slot machine G10 indicated by the stacker identification information "0002623" is not presented.

In the present embodiment, the accommodated currency type table stores stacker identification information identifying each banknote accommodation unit 100 as information for specifying each slot machine G10. However, the disclosure is not limited to this. For example, information for specifying the slot machine G10 may be identification information such as information for identifying the slot machine G10 and information for identifying the banknote processing device 1 or may be one or more of these sets of information and the stacker information.

Although not illustrated in the present embodiment, the management server 260 stores information in which information stored in the location information column of the accommodated currency type table is associated with the banknote processing terminal object 265*a* indicating each slot machine G10 provided in the map of the display screen 265*a* (see FIG. 1). That is, when the management server 260 specifies location information of the slot machine G10 which accommodates banknotes of a predetermined currency type, the banknote processing terminal object 265*b* associated with this location information is specified and this banknote processing terminal object 265*b* is differently presented (e.g., the color is changed) so as to be distinguished from other banknote processing terminal objects 265*b*. Each banknote processing terminal object 265*b* is specified by, e.g., coordinates in the map of the display screen 265*a* (see FIG. 1) and an ID indicating the object.

In this regard, a method of presenting the specified slot machine G10 is not limited to this. For example, an address of, e.g., the area where the slot machine G10 is provided in the gaming facility may be presented by characters and sound.

Figure 5:
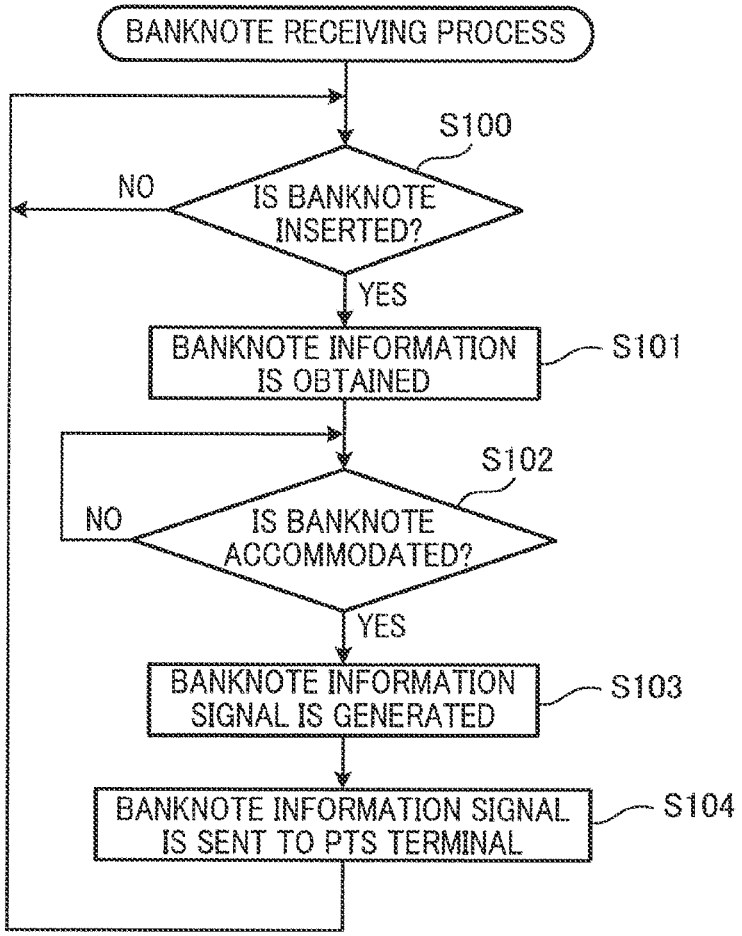
FIG. 5 is a flowchart of a banknote receiving process executed by a banknote processing device.

The following will describe a flowchart of a banknote receiving process executed by the CPU 210 of the banknote processing device 1 when the banknote processing device 1 receives a valid banknote, with reference to FIG. 5. It should be noted that descriptions of conveyance of the banknote are omitted.

To begin with, the CPU 210 determines whether a valid banknote is inserted (S100). When a valid banknote is not inserted (NO in S100), the CPU 210 executes the step S100 again and waits for the insertion of a valid banknote. When a valid banknote is inserted (YES in S100), the CPU 210 obtains the banknote information of the inserted banknote based on a signal from the banknote reading sensor 8 (see FIG. 3; S101). In this regard, banknote information is a currency type of a banknote, a banknote type of a banknote, a monetary amount of a banknote, etc.

Based on a signal from the discharge detection sensor 18 (see FIG. 3), the CPU 210 determines whether the banknote from which the banknote information has been read is accommodated in the banknote accommodation unit 100 (S102). When the banknote is not accommodated in the banknote accommodation unit 100 (NO in S102), the CPU 210 executes the step S102 again and waits for the accommodation of the banknote in the banknote accommodation unit 100. When the banknote is accommodated in the banknote accommodation unit 100 (YES in S102), the CPU 210 generates a banknote information signal based on the obtained banknote information (S103). To be more specific, a banknote information signal includes location information of the slot machine G10, stacker identification information for identifying the banknote accommodation unit 100, a currency type of an accommodated banknote, a banknote type, etc. The CPU 210 then sends the generated banknote information signal to the PTS terminal 700 (S104), and the process returns to the step S100.

Figure 6:
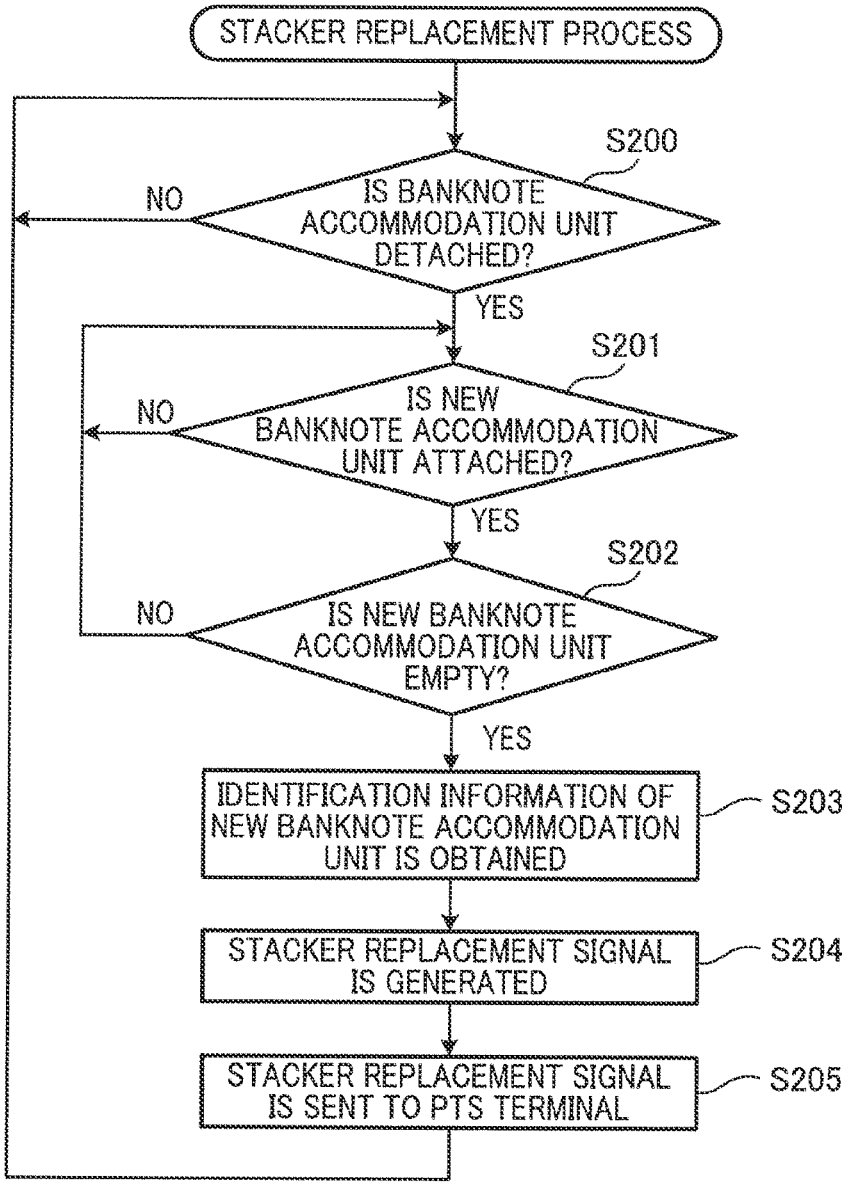
FIG. 6 is a flowchart of a stacker replacement process executed by the banknote processing device.

The following will describe a flowchart of a stacker replacement process executed by the CPU 210 of the control circuit board 200A when the banknote accommodation unit 100 is replaced in the banknote processing device 1, with reference to FIG. 6.

To begin with, the CPU 210 determines whether the banknote accommodation unit 100 is detached, based on a signal from the optical sensor 19 (see FIG. 3; S200). When the banknote accommodation unit 100 has not been detached (NO in S200), the CPU 210 executes the step S200 again and waits for the detachment.

When the banknote accommodation unit 100 has been detached (YES in S200), the CPU 210 determines whether a new banknote accommodation unit 100 has been attached (S201). When a new banknote accommodation unit 100 has not been attached (NO in S201), the CPU 210 executes the step S201 again and waits for the attachment.

When a new banknote accommodation unit 100 is attached (YES in S201), the CPU 210 determines whether a banknote is accommodated in the new banknote accommodation unit 100 based on a signal from the magnetic sensor 140 (see FIG. 3; S202). When a banknote is accommodated in the new banknote accommodation unit 100 (NO in S202), the CPU 210 causes the return to the step S201.

When no banknote is accommodated in the new banknote accommodation unit 100 (YES in S202), the CPU 210 obtains the identification information of the new banknote accommodation unit 100 (S203). The CPU 210 then generates a stacker replacement signal based on the identification information of the new banknote accommodation unit 100, the identification information of the banknote accommodation unit 100 before replacement, which is stored in the RAM 214, etc. (S204). To be more specific, a stacker replacement signal includes location information of the slot machine G10, identification information by which a banknote accommodation unit 100 before replacement is identified, and identification information by which a banknote accommodation unit 100 after replacement is identified. The CPU 210 then sends the generated stacker replacement signal to the PTS terminal 700 (S205), and the process returns to the step S200.

Figure 7:
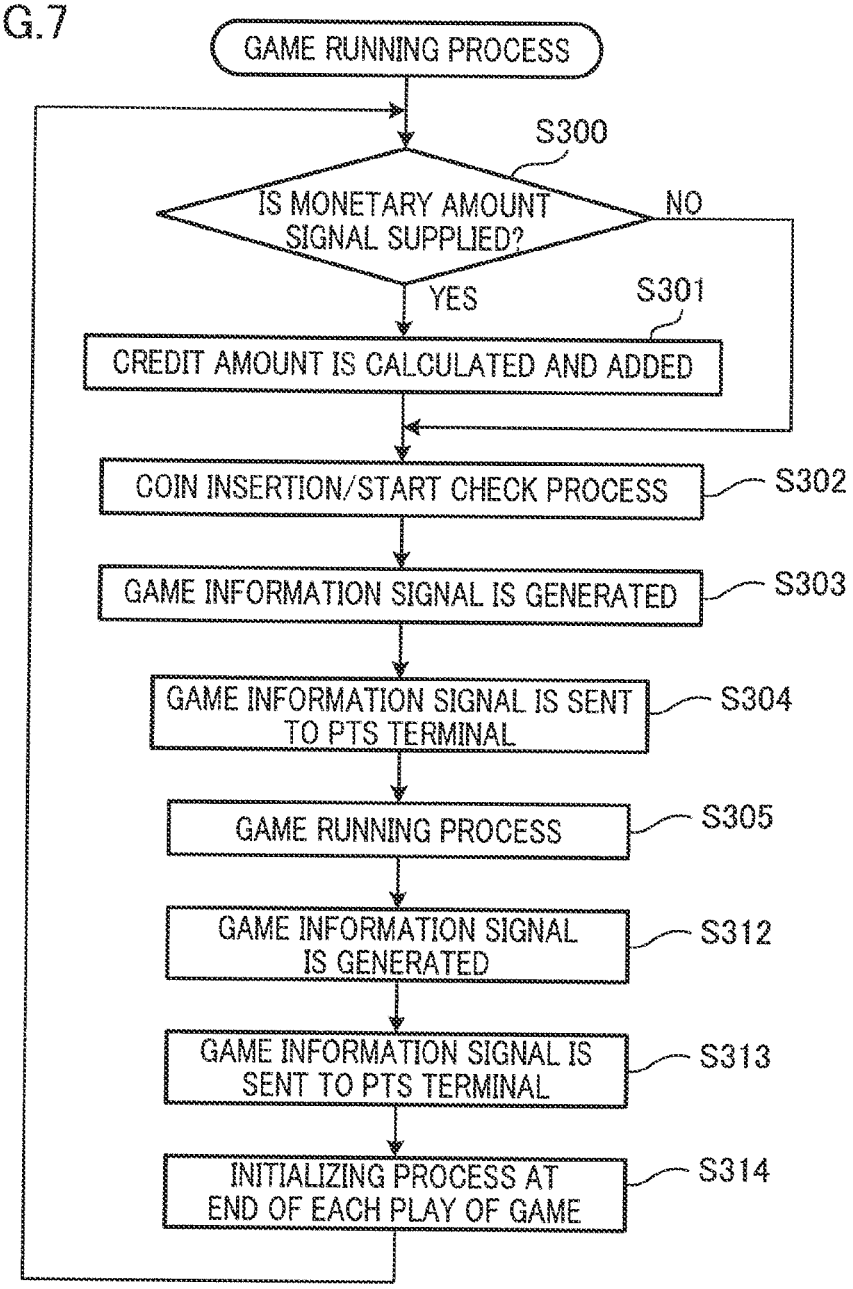
FIG. 7 is a flowchart of a game running process executed by a slot machine.

The following will describe a flowchart of a game running process executed by the game controller G100 of the slot machine G10 with reference to FIG. 7.

To begin with, the game controller G100 determines whether a monetary amount signal is supplied from the PTS terminal 700 (S300). As described later, a monetary amount signal is a signal including a monetary amount indicated by a banknote which is received by the banknote processing device 1. When the monetary amount signal has been supplied (YES in S300), the game controller G100 calculates a credit amount regarding the monetary amount signal based on a set denomination and adds the credit amount to a credit amount which is stored in the storage area and which is owned by a player (S301). In this regard, the word "denomination" refers to a monetary amount of a local currency corresponding to 1 credit. For example, if 1 credit corresponds to 10 Filipino pesos, the denomination is 10 Filipino pesos. In this regard, the denomination may be set by either the game controller G100 or the PTS terminal 700. When the denomination is set by the PTS terminal 700, the game controller G100 executes a process of obtaining the denomination from the PTS terminal 700.

After the step S301 or when no monetary amount signal is supplied (NO in S300), the game controller G100 executes a coin-insertion start-check process (S302). In this process, the control panel G30 checks inputs to the bet switch and the spin switch, etc., and a betted credit amount is subtracted from the owned credit amount. The game controller G100 then generates a game information signal based on information such as identification information by which the slot machine G10 is identified, information indicating the start of the game, information indicating a credit betted on the game, and information indicating the unit (denomination) of the credit (G303), and transmits the generated game information signal to the PTS terminal (S304).

The game controller G100 then executes the game running process (S305). In the game running process, the game controller G100 randomly determines symbols displayed in a symbol display area and outputs a game result in accordance with a combination of the displayed symbols. The game controller G100 then runs a slot game which awards a credit payout based on a betted credit amount and an output game result. For example, the symbol display area is provided with twenty areas forming a matrix with five columns and four rows and is displayed on the game image display panel G141 so that one symbol is placed in each area.

To be more specific, the game controller G100 determines to-be-stopped symbols based on a random number in the game running process. Subsequently, the game controller G100 samples an effect-use random number and randomly selects any of a plurality of predetermined effect contents. The game controller G100 then displays, on the game image display panel G141, an effect of stopping symbols in the symbol display area, based on the to-be-stopped symbols and the effect content which have been determined. The game controller G100 then determines a payout amount based on a combination of symbols in the symbol display area. When there is a payout as a result of the game above, the game controller G100 adds a payout amount to the owned credit amount.

In the game running process, the game controller G100 may execute a bonus game including at least one free game in accordance with a combination of symbols in the symbol display area and the conditions of other random determinations, etc. In this regard, the free game is a game runnable with no bet.

The game controller G100 then generates a game information signal based on information such as identification information by which the slot machine G10 is identified, information indicating the finish of the game, and information indicating a payout credit based on a game result (G312), and transmits the generated game information signal to the PTS terminal (S313).

The game controller G100 then executes an initializing process at the end of each play of the game (S314), and the process returns to S300. This initializing process at the end of each play of the game clears data in a working area of the RAM, etc. of the game controller G100, which becomes unnecessary at the end of each play of the game. Examples of such data include a bet amount and a randomly determined symbol.

Figure 8:
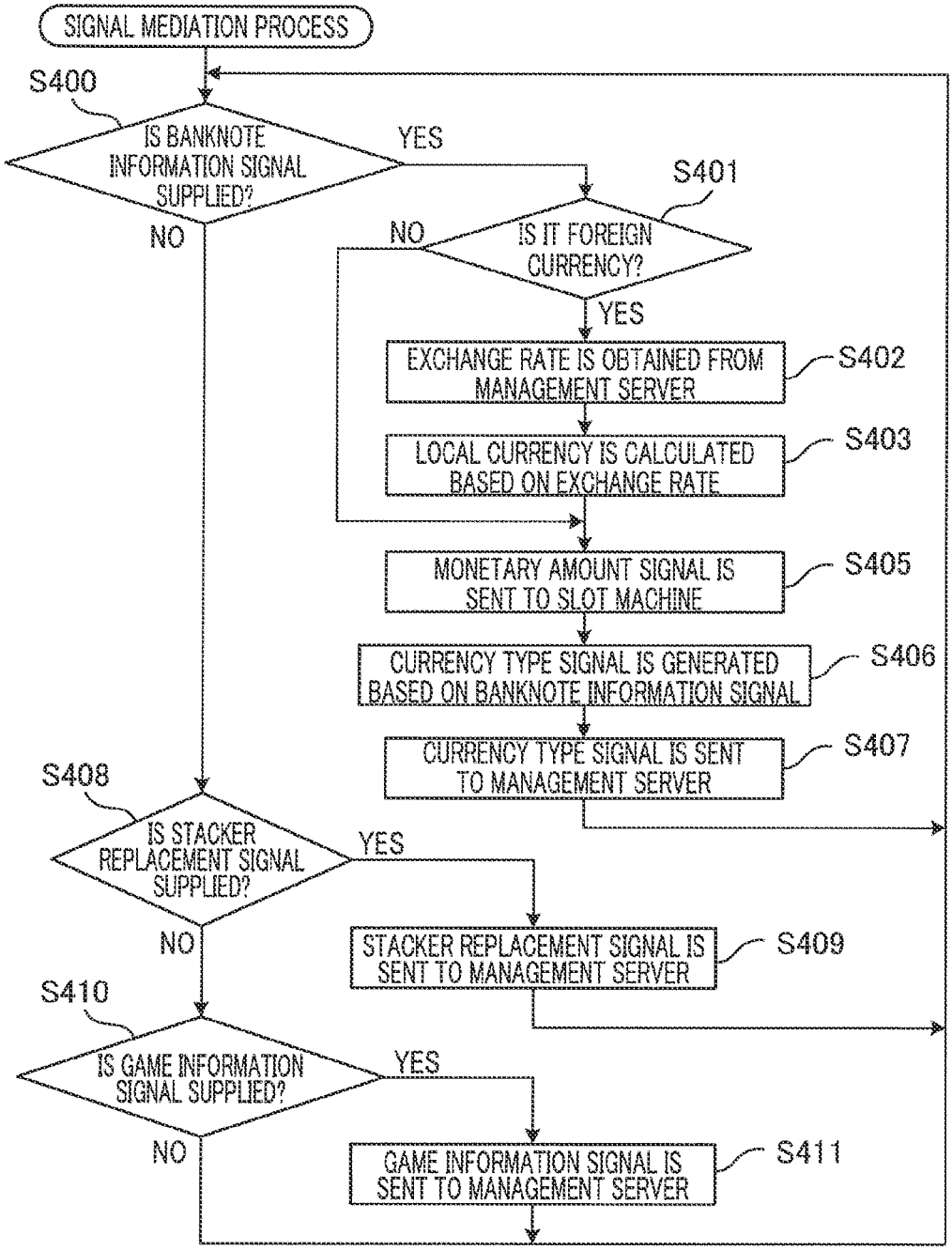
FIG. 8 is a flowchart of a signal mediation process executed by a PTS terminal.

The following will describe a flowchart of a signal mediation process executed by the smart interface board 710 of the PTS terminal 700 with reference to FIG. 8.

To begin with, the smart interface board 710 determines whether a banknote information signal is supplied from the banknote processing device 1 (S400). When the banknote information signal is supplied from the banknote processing device 1 (YES in S400), the smart interface board 710 determines whether a banknote received by the banknote processing device 1 is a foreign currency based on the banknote information signal (S401). When the banknote is a foreign currency (YES in S401), the smart interface board 710 obtains an exchange rate regarding the foreign currency from the management server 260 (S402). The smart interface board 710 then calculates a monetary amount of a local currency corresponding to the received piece of the foreign currency based on the obtained exchange rate (S403). When the banknote is not a foreign currency (NO in S401) or after the step S403, the smart interface board 710 sends a monetary amount signal indicating a monetary amount of a local currency corresponding to the received banknote to the game controller G100 of the slot machine G10 (S404). That is, when the banknote received by the banknote processing device 1 is a local currency, the smart interface board 710 sends a monetary amount of the banknote (local currency) to the game controller G100. Meanwhile, when the received banknote is a foreign currency, the smart interface board 710 sends the monetary amount which has been calculated in the step S403 to the game controller G100.

In this regard, the smart interface board 710 may calculate a credit based on the set denomination and send a credit information signal indicating the calculated credit amount to the game controller G100. That is, the smart interface board 710 calculates a credit amount corresponding to a monetary amount indicated by the banknote received by the banknote processing device 1, and when the received banknote is a foreign currency, the smart interface board 710 calculates a credit amount corresponding to the monetary amount having been calculated in the step S403. When there is a fraction less than 1 credit, a process of storing the fraction into a member card, etc., inserted into the card insertion slot of the PTS terminal 700 may be executed.

The smart interface board 710 then generates a currency type signal based on location information, which is included in the banknote information signal, of the slot machine G10, stacker identification information for identifying the banknote accommodation unit 100, and a currency type and banknote type of an accommodated banknote, etc., (S406), sends the currency type signal to the management server (S407), and the process returns to the step S400.

When the banknote information signal is not supplied from the banknote processing device 1 (NO in S400), the smart interface board 710 determines whether a stacker replacement signal is supplied from the banknote processing device 1 (S408). When the stacker replacement signal is supplied from the banknote processing device 1 (YES in S408), the smart interface board 710 sends the stacker replacement signal to the management server 260 (S409) and the process returns to the step S400.

When the stacker replacement signal is not supplied from the banknote processing device 1 (NO in S408), the smart interface board 710 determines whether a game information signal is supplied from the slot machine G10 (S410). When the game information signal is supplied from the slot machine G10 (YES in S409), the smart interface board 710 sends the game information signal to the management server 260 (S411) and the process returns to the step S400. When the game information signal has not been supplied in the step S406 (NO in S410), the process returns to the step S400.

Figure 9:
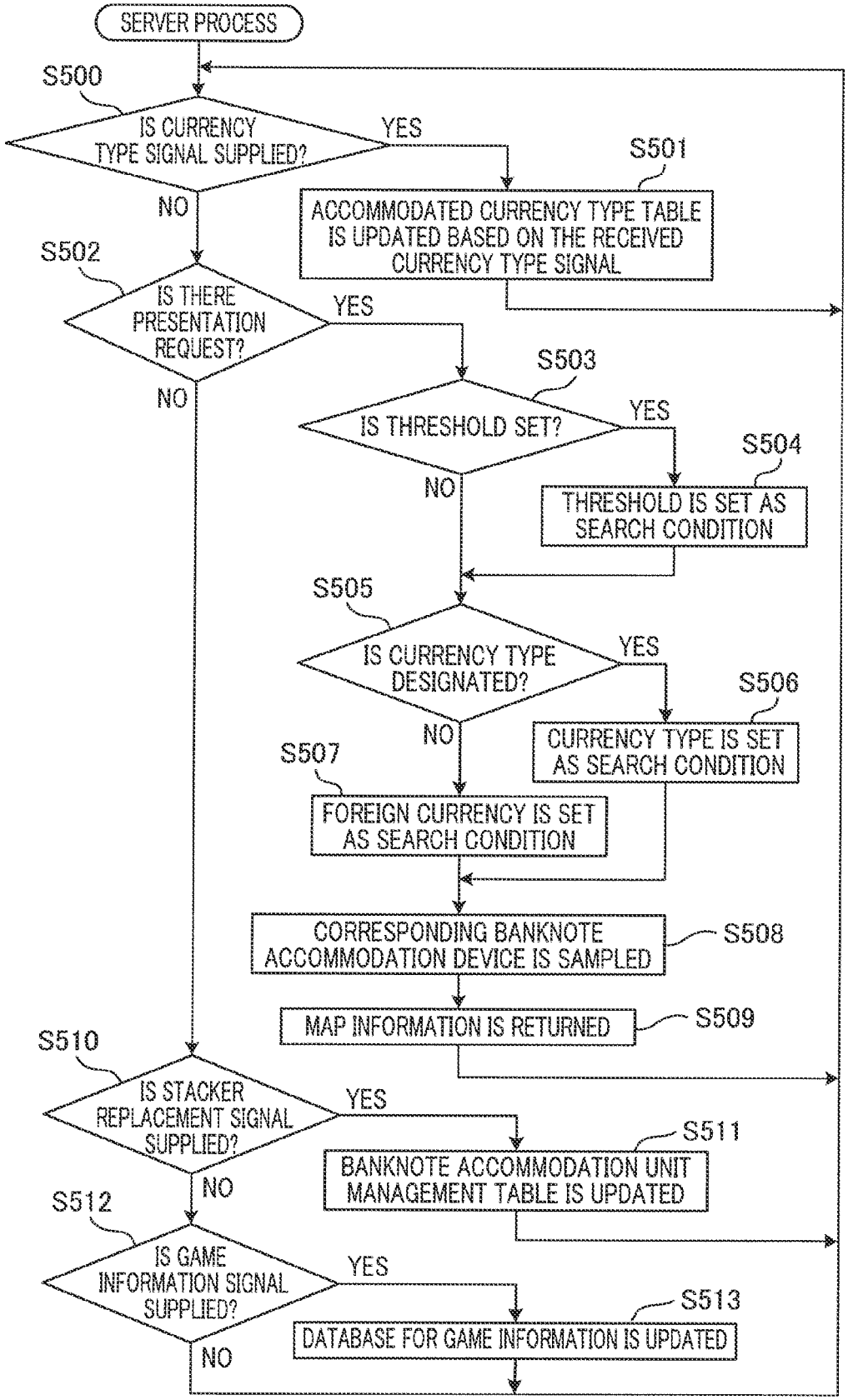
FIG. 9 is a flowchart of a server process executed by a management server.

The following will describe a flowchart of a server process executed by the center controller 261 of the management server 260 with reference to FIG. 9.

To begin with, the center controller 261 determines whether a currency type signal is supplied (S500). When the currency type signal is supplied, the center controller 261 updates the accommodated currency type table based on the supplied currency type signal (S501) and the process returns to the step S500. To be more specific, in the step S501, with reference to the accommodated currency type table (see FIG. 4), the center controller 261 searches for data which corresponds to the stacker identification information, currency type, and banknote type which are included in the currency type signal. Then, if there is corresponding data, 1 is added to the number column of the data. At this stage, it is determined whether the location information included in the currency type signal is identical with the location information of the corresponding data. When these sets of information are different from each other, the location information included in the currency type signal is reflected to all sets of data in which the stacker identification information is identical with the stacker identification information included in the currency type signal. If there is no corresponding data, data is added and one is stored in the number column of the added data. At this stage, the location information column of the added data stores the location information included in the currency type signal.

When the currency type signal is not supplied in the step S500 (NO in S500), the center controller 261 determines whether there is a presentation request (S502). The presentation request is a request for presenting an installation location of the slot machine G10 associated with a predetermined currency type, and may be requested by the center controller 261 itself based on an input received by the input device 264 or may be requested from a portable terminal (not illustrated) such as a tablet connected to the management server 260 in a data communicable manner.

When there is the presentation request (YES in S502), the center controller 261 determines whether a threshold is set for the presentation request (S503). The threshold indicates a threshold of the number of banknotes for each currency type. That is, when a threshold is set, a slot machine G10 in which the number of accommodated banknotes of a predetermined currency type in the accommodation unit 100 is equal to or more than the threshold is presented. When a threshold is set for the presentation request (YES in S503), the center controller 261 sets the threshold as a search condition (S504).

When a threshold is not set for the presentation request in the step S503 (NO in S503) or after the step S504, the center controller 261 determines whether a currency type is designated for the presentation request (S505). When a predetermined currency type is designated for the presentation request (YES in S505), the center controller 261 sets the designated currency type as a set condition (S506). When a currency type is not designated for the presentation request (NO in S505), the center controller 261 sets foreign currencies as a set condition (S506). That is, when a currency type is designated for the presentation request, only the slot machine G10 which accommodates banknotes of this currency type in the banknote accommodation unit 100 is presented. Meanwhile, when a currency type is not designated for the presentation request, only the slot machine G10 which accommodates pieces of any foreign currency in the banknote accommodation unit 100 is presented. As such, while the slot machine G10 accommodating pieces of a foreign currency is presented in the default setting of the present embodiment, the disclosure is not limited to this.

After the step S506 or the step S507, the center controller 261 samples the corresponding slot machine G10 from the accommodated currency type table (see FIG. 4) based on the set search condition (S507). To be more specific, when a threshold is set, the number of banknotes of a currency type corresponding to the search condition in each set of data of the same stacker identification information is accumulated and the location information and stacker identification information of data in which the number of banknotes is equal to or more than the threshold are sampled. When the threshold is not set, the location information and stacker identification information of data including a currency type corresponding to the search condition are sampled. After that, map information is returned for generating the display screen 265*a* based on information such as a map image, information of banknote processing terminal objects 265*b* provided in the map image, and information of a banknote processing terminal object 265*b* corresponding to the search condition among the banknote processing terminal objects 265*b* (S509), and the process returns to the step S500.

As such, in the banknote processing system 1000, the management server 260 stores the number of banknotes accommodated by the slot machine G10 for each currency type based on the currency type signal and presents an installation location of the slot machine G10 in which the number of accommodated banknotes of a predetermined currency type is equal to or more than the threshold. Because of this, an administrator who manages slot machines G10 can easily identify the slot machine G10 in which the number of accommodated banknotes of a predetermined currency type is equal to or more than the threshold.

In the banknote processing system 1000, the management server 260 receives the designation of one of currency types and specifies the slot machine G10 associated with the designated currency type. With this arrangement, because the slot machine G10 which accommodates banknotes of the designated currency type is specified, an installation location of the specified slot machine G10 is presented. As a result, because an installation location of the slot machine G10 which accommodates banknotes of the designated currency type is presented, the slot machine G10 which accommodates banknotes of the designated currency type is easily specified.

When there is no presentation request in the step S502 (YES in S502), the center controller 261 determines whether a stacker replacement signal is supplied (S510). When the stacker replacement signal has been supplied (YES in S510), the center controller 261 updates the accommodated currency type table (see FIG. 4; S511) and the process returns to the step S500. To be more specific, in the step S507, with reference to the accommodated currency type table (see FIG. 4), the center controller 261 searches for data which corresponds to the stacker identification information of the slot machine G10 which has supplied the stacker replacement signal. Then the location information of the corresponding data is nullified.

When the stacker replacement signal is not supplied in the step S510 (NO in S510), the center controller 261 determines whether a game information signal is supplied (S512). When the game information signal is supplied (YES in S512), the center controller 261 updates a database (not illustrated) storing game information with information based on the supplied game information signal (S513). After the step S513 or when the game information signal has not been supplied in the step S512 (NO in S508), the process returns to the step S500.

Although not illustrated, when a slot machine G10 or a table machine G9 requests an exchange rate, the center controller 261 suitably sends the exchange rate of a designated foreign currency to the gaming machine which has requested the exchange rate.

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

REFERENCE SIGNS LIST

1 banknote processing device
8 banknote reading sensor
18 discharge detection sensor
100 banknote accommodation unit
104 RFID tag
142 reader-writer
260 management server
261 center controller
262 storage unit
301 communication line
700 PTS terminal
710 smart interface board
1000 banknote processing system
G10 slot machine (banknote processing terminal)
G100 game controller

The invention claimed is:

1. A banknote processing system, comprising:

a plurality of banknote processing terminals, each of which is provided in one of a plurality of gaming machines and is configured to receive and process banknotes of multiple national or regional currency types, includes a reader unit configured to read to which national or regional currency type a banknote received by the banknote processing terminal belongs, and includes a banknote type transmitter configured to transmit a national or regional currency type signal that indicates whether the national or regional currency type which has been read by the reader unit is a preselected national or regional currency type and identification information specifying an installation location of the associated banknote processing terminal;

a plurality of accommodation units, each of which is provided in one of the plurality of gaming machines and is configured to accommodate therein banknotes from which the national or regional currency type has been read by the reader unit of the banknote processing terminal in the associated gaming machine; and an external device connected to the banknote processing terminals via a communication line, the external device including a location information storage unit, an external-device-side receiver configured to receive from each of the banknote type transmitters, via the communication line, the transmitted national or regional currency type signal and identification information, an accommodated national or regional currency type storage unit which, when the received national or regional currency type signal indicates that a banknote of the preselected national or regional currency type has been read by the associated reader unit, stores the identification information for the banknote processing terminal in which is provided the reader unit that has sent the received national or regional currency type signal in association with the national or regional currency type indicated by the national or regional currency type signal, and a banknote processing terminal specifying unit configured 1) to specify the banknote processing terminal from which has been received a national or regional currency type signal indicating that a banknote of the preselected national or regional currency type has been read by the associated reader unit, and 2) to store the location information for the so-specified banknote processing terminal in the location information storage unit, and a presentation unit configured to refer to the location information stored in the location information storage unit and to present, on a map, the location of the banknote processing terminal from which has been transmitted the national or regional currency type signal in a manner that the banknote processing terminal from which has been transmitted the national or regional currency type signal is distinguishable from other banknote processing terminals in which banknotes of the predetermined national or regional currency type are not accommodated.

2. The banknote processing system according to claim 1, wherein the accommodated national or regional currency type storage unit stores the number of banknotes accommodated by the accommodation unit in each of the banknote processing terminals for each national or regional currency type based on the national or regional currency type signal, and the presentation unit includes a display screen and presents on the map on the display screen the installation location of each gaming machine in which the number of accommodated banknotes of the preselected national or regional currency type is equal to or more than a threshold.

3. The banknote processing system according to claim 1, wherein for each of the plurality of gaming machines, the accommodation unit comprises a bill stacker and the banknote processing terminal includes an accommodation unit-presence sensor and a banknote-presence sensor, and the banknote processing terminal is configured 1) to determine, using the accommodation unit-presence sensor, whether the accommodation unit has been removed from the banknote processing terminal and whether another, replacement accommodation unit has been installed in the banknote processing terminal; 2) to determine, using the banknote-presence sensor, whether a banknote is present in the replacement accommodation unit; and 3) upon determining that no banknote is present in the replacement accommodation unit, to generate and transmit to the external device a stacker replacement signal based on identification information associated with the replacement accommodation unit and identification information associated with the banknote processing terminal in which the replacement accommodation unit has been installed, whereby location of the replacement accommodation unit is ascertainable via the location information stored in the location information storage unit in association with the banknote processing terminal in which the replacement accommodation unit has been installed.

4. A banknote processing system, comprising:

a plurality of banknote processing terminals, each of which is provided in one of a plurality of gaming machines and is configured to receive and process banknotes of multiple national or regional currency types, includes a reader unit configured to read to which national or regional currency type a banknote received by the banknote processing terminal belongs, and includes a banknote type transmitter configured to transmit a national or regional currency type signal that indicates whether the national or regional currency type which has been read by the reader unit is a preselected national or regional currency type and identification information specifying an installation location of the associated banknote processing terminal;

a plurality of accommodation units, each of which is provided in one of the plurality of gaming machines and is configured to accommodate therein banknotes from which the national or regional currency type has been read by the reader unit of the banknote processing terminal in the associated gaming machine; and an external-device-side receiver configured to receive from each of the banknote type transmitters, via the communication line, the transmitted national or regional currency type signal and identification information, an accommodated national or regional currency type storage unit which, when the received national or regional currency type signal indicates that a banknote of the preselected national or regional currency type has been read by the associated reader unit, stores the identification information for the banknote processing terminal in which is provided the reader unit that has sent the received national or regional currency type signal in association with the national or regional currency type indicated by the national or regional currency type signal, and a banknote processing terminal specifying unit configured 1) to specify the banknote processing terminal from which has been received a national or regional currency type signal indicating that a banknote of the preselected national or regional currency type has been read by the associated reader unit, and 2) to store the location information for the so-specified banknote processing terminal in the location information storage unit, and a presentation unit configured to present the installation location of the banknote processing terminal specified by the banknote processing terminal specifying unit;

wherein for each of the gaming machines in the plurality of gaming machines the associated reader unit is configured to read 1) to which national or regional currency type a banknote in a local currency received by the banknote processing terminal belongs and 2) to which national or regional currency type a banknote of at least one foreign currency received by the banknote processing terminal belongs; and wherein the banknote processing system is configured such that the value of foreign currency received by the banknote processing terminal is converted to value in local currency and the value in local currency is stored in association with a user who inserted the foreign currency into the banknote processing terminal, whereby the user who inserted the foreign currency into the reader unit can utilize its value as converted to value in the local currency.

5. The banknote processing system according to claim 4, wherein the accommodated national or regional currency type storage unit stores the number of banknotes accommodated by the accommodation unit provided in each gaming machine in the plurality of gaming machines for each national or regional currency type based on the transmitted national or regional currency type signal, the presentation unit is configured to refer to the location information stored in the location information storage unit and to present, on a map, the location of the banknote processing terminal from which has been transmitted the national or regional currency type signal in a manner that the banknote processing terminal from which has been transmitted the national or regional currency type signal is distinguishable from other banknote processing terminals in which banknotes of the predetermined national or regional currency type are not accommodated; and includes a display screen and presents on the map on the display screen the installation location of each gaming machine in which the number of accommodated banknotes of the preselected national or regional currency type is equal to or more than a threshold.

6. The banknote processing system according to claim 4, wherein for each of the plurality of gaming machines, the accommodation unit comprises a bill stacker and the banknote processing terminal includes an accommodation unit-presence sensor and a banknote-presence sensor, and the banknote processing terminal is configured 1) to determine, using the accommodation unit-presence sensor, whether the accommodation unit has been removed from the banknote processing terminal and whether another, replacement accommodation unit has been installed in the banknote processing terminal; 2) to determine, using the banknote-presence sensor, whether a banknote is present in the replacement accommodation unit; and 3) upon determining that no banknote is present in the replacement accommodation unit, to generate and transmit to the external device a stacker replacement signal based on identification information associated with the replacement accommodation unit and identification information associated with the banknote processing terminal in which the replacement accommodation unit has been installed, whereby location of the replacement accommodation unit is ascertainable via the location information stored in the location information storage unit in association with the banknote processing terminal in which the replacement accommodation unit has been installed.

* * * * *